US006891121B2

(12) United States Patent
Ren

(10) Patent No.: US 6,891,121 B2
(45) **Date of Patent: *May 10, 2005**

(54) INTEGRATED CONTACT FOR POWER SWITCHGEAR

(75) Inventor: Jianchang Ren, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 10/648,727

(22) Filed: Aug. 25, 2003

(65) Prior Publication Data

US 2004/0035828 A1 Feb. 26, 2004

Related U.S. Application Data

(63) Continuation of application No. PCT/CN01/01513, filed on Oct. 29, 2001.

(30) Foreign Application Priority Data

Feb. 28, 2001 (CN) ..... 01109233 A

(51) Int. Cl.[7] ..... H01H 33/66
(52) U.S. Cl. ..... 218/130; 218/123; 218/127
(58) Field of Search ..... 218/118, 123–133

(56) References Cited

U.S. PATENT DOCUMENTS 4,117,288 A * 9/1978 Gorman et al. ..... 218/129
4,935,588 A * 6/1990 Hess et al. ..... 218/123
5,055,639 A * 10/1991 Schels et al. ..... 218/129
5,557,083 A * 9/1996 Komuro et al. ..... 218/123
5,777,287 A * 7/1998 Mayo ..... 218/123

FOREIGN PATENT DOCUMENTS

EP 0192251 8/1986
EP 0199594 10/1986

* cited by examiner

*Primary Examiner*—Lincoln Donovan
*Assistant Examiner*—M. Fishman
(74) *Attorney, Agent, or Firm*—J.C. Patents

(57) ABSTRACT

An integrated contact for power switchgear, its arc proof component, magnetic field generating component and conductive component are set in an open container. The conductive component and the magnetic field generating component are mutually combined and set at the bottom of the container, the arc proof component is set on top of the combination of the conductive component and the magnetic field generating component. The conductive component passes through the center of the container, and from top to down, it equally divides the container; the magnetic field generating component is isolated by the conductive component and set at the other part of the container. The contact surface of the invention has multiple pole axial magnetic fields, the contact is suitable used for integrated contact for interrupting high volume current in arc extinguished chamber of vacuum interrupter. The invention belongs to electrical equipment field.

16 Claims, 10 Drawing Sheets

INTEGRATED CONTACT FOR POWER SWITCHGEAR

CROSS-REFERENCE TO RELATED APPLICATION

This application is a continuation of international application PCT/CN01/01513 filed on Oct. 29, 2001, which claims the priority benefit of Chinese application No. 01109233.5 filed on Feb. 28, 2001.

FIELD OF THE INVENTION

The present invention relates to a structure of an integrated contact for power switchgear, especially a structure of an integrated contact in an arc extinguished chamber of a vacuum interrupter. It belongs to electrical equipment field.

BACKGROUND OF THE INVENTION

Switchgear is an essential equipment in circuit which plays switching on and switching off function in the circuit. While switching off, switchgear has very high resistance in order to withstand certain voltage; While switching on, it must have very low resistance in order to pass rated current without overheat. During switchgear contacts interrupting, arc extinguishing is necessary to make contacts to be quickly separated. At present, there are different kinds of arc extinguishing medium: oil, sulphur hexafluride ($SF_6$), air, semiconductor and vacuum etc. Different arc extinguishing mediums correspond to different interrupter structures and with different properties. As vacuum interrupter has small gap, high withstand voltage, low arc voltage, high current interrupting capability, low electrode erosion and high electric life, so it is broadly used in power line under 35 KV voltage. As shown in FIG. 1, the heart of a vacuum interrupter 7 is its vacuum arc extinguished chamber 6 within envelope 5. The properties of contacts 1 and 2 within vacuum arc extinguished chamber 6 determine properties of vacuum interrupter 7 directly. The rear of contacts 1 and 2 of vacuum interrupter 7 is connected to moving electrode 3 and stationary electrode 4, respectively, interruption of contacts 1 and 2 is mechanically operated by moving electrode 3. During interruption, contact area of contacts 1 and 2 is getting smaller until there is only one contact point between contacts 1 and 2. At the same time, contact resistance and area temperature are increased until the contact point is melted, vaporized and ionized. Metal vapor keeps discharge procedure to be continued in vacuum and produces vacuum arc, finally contacts are electrically interrupted. In order to raise interrupting capability of vacuum interrupter, it is necessary to provide vacuum arc with axial magnetic field, which maintains vacuum arc at a stable and dispersive state. In this way, current will be well distributed on contact surface, temperature on contact surface will be decreased and amount of vaporization of contact material is avoided, all of these maintaining arc voltage at a lower level and decreasing electrical erosion of contact. Therefore, contacts in arc extinguished chamber of vacuum interrupter must have abilities of burning arc, conducting electrically and producing magnetic field. Its technical parameters need to satisfy following requirements: excellent anti-welding characteristics, excellent voltage withstanding characteristics, high current-interrupting capability, excellent anti-electric erosion characteristics, low current chopping characteristics, low air content, high conductivity, small geometric size and high reliability etc. Currently, the contact consists of an arc proof component, a conductive component and a magnetic field generating component. As shown in FIG. 2, the arc proof component 11 is set in the middle part and consists of copper-chromium (CuCr) material, which has large current interrupting capability and excellent anti-welding characteristics and produces metal vapor during interrupting time to maintain current. The conductive component 12 is a round contact body and is generally made of copper material. The magnetic field generating component 13 is an inductance coil and set outside of the contact body; whether at an axial magnetic field or at a radial magnetic field, its magnetic field intensity is comparatively low. When assembled, it is necessary to solder in a vacuum and heating furnace with silver copper solder to combine the components together. As every component is complicated, one soldering step can only perform part of the soldering job; so during manufacturing, it is not only necessary to enter vacuum and heating furnace many times for soldering, but the following problems also exist which cause the contact electrical properties to be not good enough: contact of the soldering surface is not 100%, quality of soldering surface and strength of soldering have not been guaranteed and burr on soldering surface is unavoidable etc. For reasons mentioned above, with current technology, production of vacuum interrupter not only has low ratio of final product, complicated procedure, these causing high cost, but does not have ideal electrical properties either. In addition, all components need various professional forms of copper-chromium alloy materials and machining work, such as lathing and milling, of the alloy materials is complicated.

There is another product, developed by HOLEC Co., Netherlands, with current technology, its magnetic field generating component 13 discards the original coil form and substitutes it with a set of electrical iron sheets 13, which is piled on CuCr arc proof component 11 of contact body and is fasten with rivet 14. Electrical iron sheets 13 have different sizes of break 131, 132 and 133, magnetic field is produced by induced current in the electrical iron sheets, and its concrete structures are shown in FIG. 3 and FIG. 4. The piled electrical iron sheets 13 on CuCr arc proof component 11 form a ladder-shape, when it is seen from front view; this not only simplifies the original contacts structure, but also increases the magnetic field intensity greatly. Even with this structure, the soldering method must be used in order to combine the separated conductive component 12 and electrical iron sheet 13 together. As machining methods of the structure are unchanged basically, so its cost and quality still have quite a few problems. In addition, as electrical iron sheets 13 are piled in plane, according to the right-handed screw law, when magnetic induce reaches the break of sheets and goes up layer by layer to form an axial magnetic flux, so the magnetic resistance is comparatively high. Furthermore, as the sheets 13 are piled in a ladder-shaped form, the heat conductive body is an eccentric body; this asymmetrical heat conductive body makes instant heat diffusion effect badly; which not only influences contact interrupting capability, but also makes the whole structure deform easily.

No matter which form is used, a very important point for the current contact structure is that, without any exception, every component of it is separately made. Therefore, manufacturing procedures are various, the quality is unstable and the properties are not good enough. This is just like the separated electronic elements in the early days, to implement an electrical function many separated elements needed to be soldered together. This not only increases working procedures and size, but also decreases reliability and properties.

In addition to increasing costs by the complicated structure and manufacturing procedures described above, the current technology used to produce the contact wastes great quantities of contact materials. Either as shown in FIG. 2, the traditional structure, or as shown in FIG. 3 and FIG. 4, the improved structure, remaining leftover bits and pieces after manufacturing of the components cannot be rationally used. So, the cost of the vacuum interrupter is increased.

Another important point is that, with the current technology the axial magnetic field on the contact surface is not well distributed. At the same time, external stray magnetic fields influence interrupting capability of contacts. Especially for the contact of a high volume interrupter, its axial magnetic field is more concentrated on a local part and this leads to a worse interrupting capability under high volume current condition. This disadvantage is a big limitation for production of high volume vacuum interrupters. In practice, accompanying with electricity is widespread used, demand of high volume vacuum interrupter is increased rapidly; for example: an electric generator requires control of electrical currents greater than one hundred and twenty (120) kilo amps (kA), on a distributing line using a vacuum interrupter as an interrupting device.

SUMMARY OF THE INVENTION

In one embodiment, the present invention provides an integrated contact with an integrated directly assembled structure, for power switchgear. The present invention, eliminates the need of soldering for combining and it changes the separated setting structure of all components in the current technology.

In one embodiment, the invention provides an integrated contact with a tight structure and smaller geometric size, for power switchgear. An integrated contact has a high intensity magnetic field, good heat conductivity, high interrupting capacity and longer electric live, for power switchgear. The axial magnetic field is well distributed on the contact surface, which is suited for a high volume interrupter and has a greater interrupting capacity, when used for power switchgear.

DETAILED DESCRIPTION

An integrated contact is described that combines contact components, which are separately set in existing contacts, into a container, wherein the container acts as an external package of the contact so that the contact has an integrated whole structure. Specifically, magnetic a field generating component and a conductive component are mutually combined and set at the bottom of the container, an arc proof component is set on top of the combination of the magnetic field generating component and the conductive component. The magnetic field generating component has magnetic path open break. The combining of the magnetic field generating component and the conductive component produces axial magnetic field. The container can be a cup-like body, and its materials are rigid, the melt point of the container is higher than the melting point of any component in the container, for example, the container material can be rustless steel whose melting point is higher than eleven hundred (1100) degrees Centigrade. The conductive component material can be conductive, with respect to electricity and heat, and have high magnetic resistance. Pure copper or red copper material can be used, with a melting point is of one thousand eighty three (1083) degrees Centigrade. In order to achieve a melting state for the conductive component in the furnace, the temperature of the furnace must be higher than one thousand eighty three (1083) degrees Centigrade. Therefore, the melting point of the container must be higher than eleven hundred (1100) degrees Centigrade. Part or all materials of the magnetic field generating component are soft magnetic materials, for example electric iron.

As there is a container outside the contact, the state of the arc proof component, the magnetic field generating component and the conductive component can be powder, sheet or board, bar, tube or block, that produces an axial magnetic field with magnetic flux coming in and going out on the contact surface.

In one embodiment, the arc proof component 84 is made of a block or a plate of an alloy material containing pure copper and pure chromium. In one embodiment, that lowers the cost of materials for the arc proof component, an alloy material of pure copper and pure chromium is substituted with a mixture of general copper powder and chromium powder. According to different requirements, the ratio of the copper powder and the chromium powder can be varied from 10:90 to 90:10. In one embodiment of the invention, the granule number of the copper powder is 325 mesh, the granule number of the chromium powder is 325 mesh and the copper powder can be substituted by silver powder.

Figure 5:
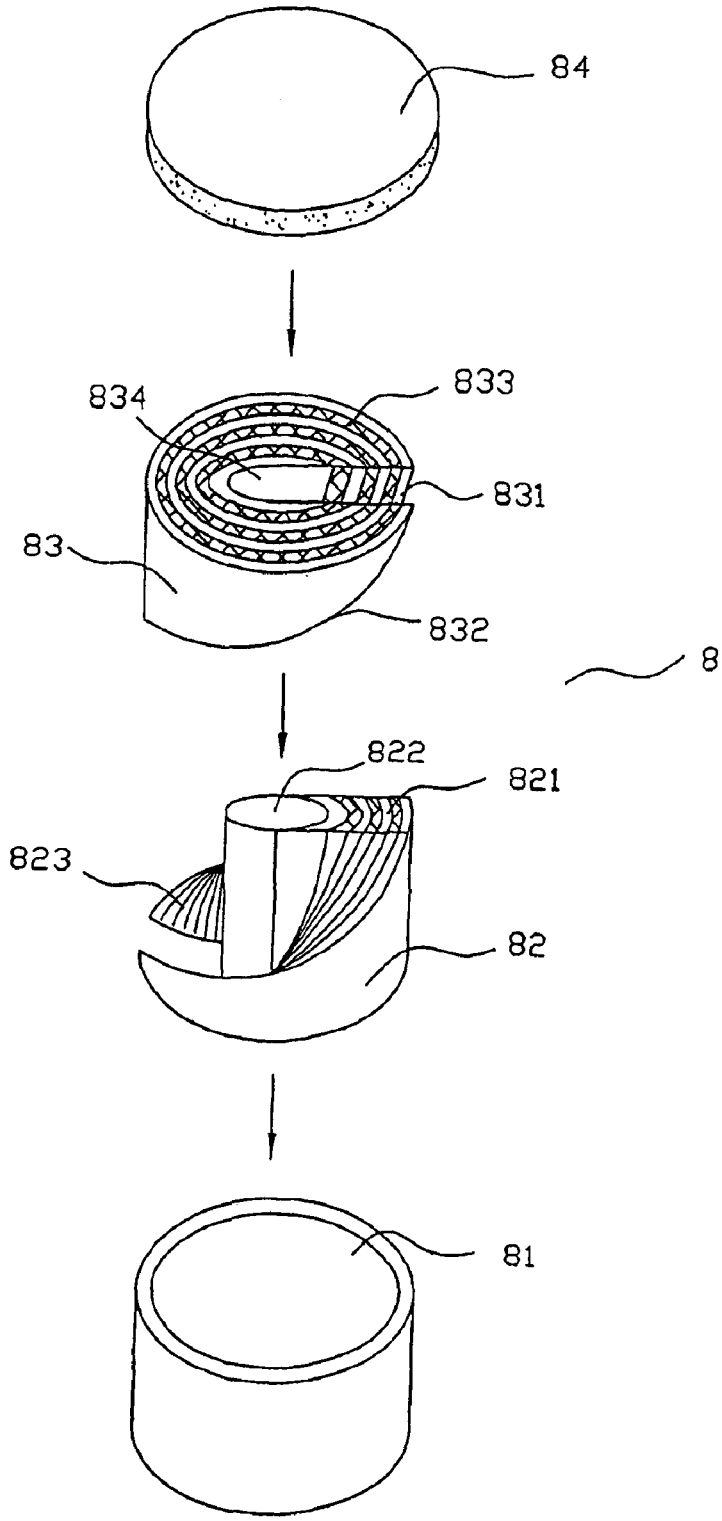
FIG. 5 is a perspective schematic diagram of a contact structure according to one embodiment of the invention.

In embodiment 1, with reference to FIG. 5, a schematic diagram of a structure of an embodiment of the invention is shown. The arc proof component 84 of the contact 8, the conductive component 82 and the magnetic field generating component 83 are all set in a cup-like body 81 which has an open mouth at its top.

The magnetic field generating component 83 can be a multi-layer cylinder structure 833 with different diameters and with an insulated layer between any two layers. The multi-layer cylinder 833 can have one layer, or more than one layer or all layers of soft magnetic material, in order to produce different required intensities of the magnetic field. The magnetic field generating component 83 has a through oblique section 832 from top to bottom at its side facing the center of the cup-like body 81. The magnetic path of the magnetic field generating component 83 is opened by the break 831 from top to bottom. At the middle of the magnetic field generating component, there is a through hole 834 from top to bottom. The distance of the break 831 of the magnetic field generating component 83 can be greater than the real electromagnetic physical gap between two contacts placed oppositely in the interrupter, to guarantee sufficient intensity of the axial magnetic field between the two contacts. The oblique section 832 of the magnetic field generating component 83 is a top to down symmetric oblique section along the central axis of the cylinder body, i.e. the upper part section arc is equal to the lower part section arc. The upper part of the conductive component 82 is a supporting oblique section 823 to fix the corresponding oblique section of the magnetic field generating component properly. In this embodiment, the conductive component 82 is a multi-layer cylinder structure 821 with cylinders having different diameters combined together; at the center of the cylinder 821, there is a cylinder body 822 inserted into a central through-hole 834 of the magnetic field generating component 83.

The conductive component 82 and the magnetic field generating component 83 are combined and set on the bottom of the cup-like body 81, while the arc proof component 84 is set on the combination of the conductive component 82 and the magnetic field generating component 83. The shape of the combination of the magnetic field generating component 83 and the conductive component 82 has a cylinder form corresponding to the cup-like body 81, when combined against each other. In this way, according to right-handed screw law, while current is passing through the conductive component 82, the magnetic field generating component 83 produces a magnetic field and the surface of the contacts has a powerful magnetic flux coming in and going out.

Figure 6:
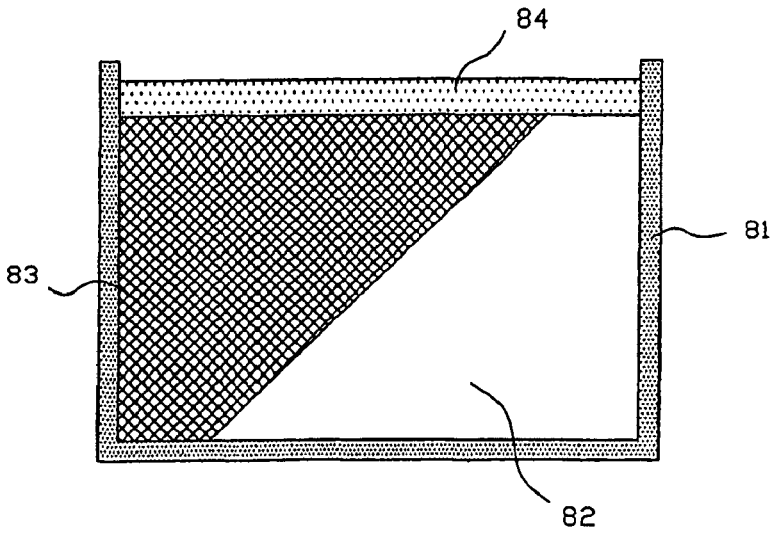
FIG. 6 is a section diagram of the contact structure according to one embodiment of the invention.
Figure 7:
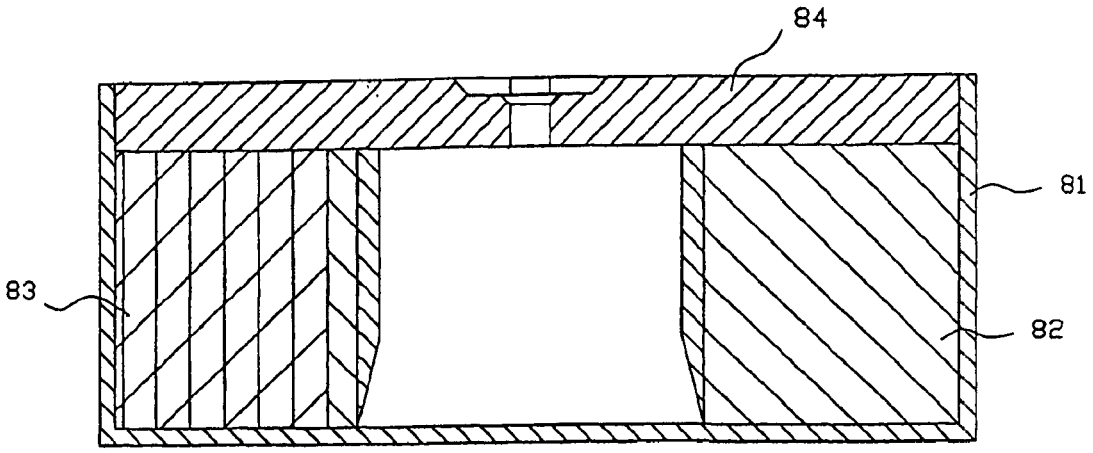
FIG. 7 is a schematic central section diagram of the contact structure for a preferred embodiment of the invention.

In embodiment 1, the mutual combined sections of the magnetic field generating component 83 and the conductive component 82 form a symmetric mean equal division structure as shown in FIG. 6 and FIG. 7. In one embodiment, the shape of the magnetic field generating component 83 and the conductive component 82 is symmetric and coordinated. When making the magnetic field generating component 83 and the conductive component 82 of a contact, the remaining cut is just for the magnetic field generating component 83 and the conductive component 82 of another contact. There is not any wasted material and better heat conductivity results.

Figure 8:
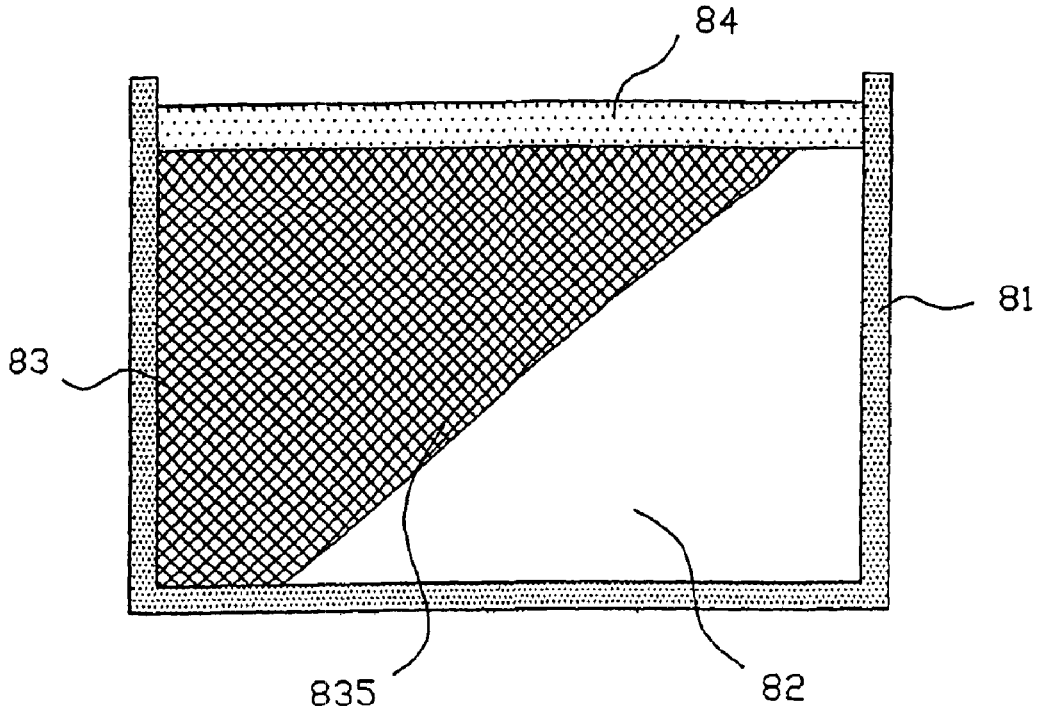
FIG. 8 is the first schematic diagram of the combining structure on section of the contacts for the magnetic field generating component and the conductive component of the invention.

Embodiment 2, as shown in FIG. 8, is a schematic diagram of a non-mean equal division structure of the combined sections of the magnetic field generating component 83 and the conductive component 82, as described in conjunction with embodiment 1 above. Along the central axis, the cylinder shape body of the magnetic field generating component is sectioned obliquely and asymmetrically from top to bottom, the shape of the section is a trapezium 835. This means that, from a front view sight, the area of the magnetic field generating component 83 can be bigger than the area of the conductive component 82 to satisfy different property requirements of the contact.

Figure 9:
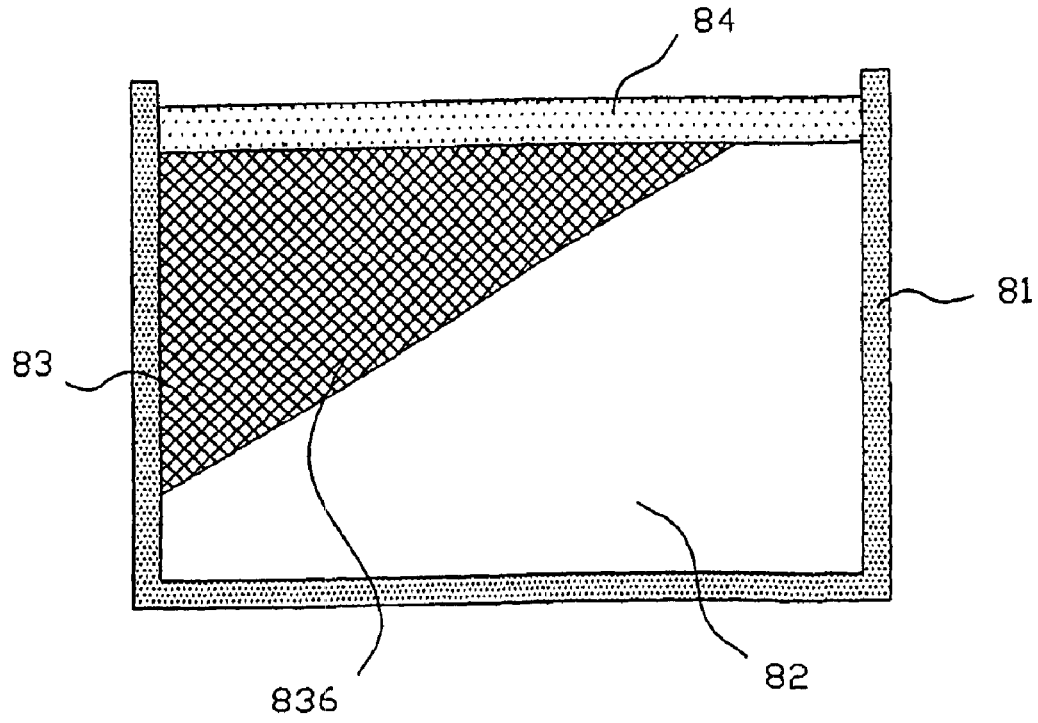
FIG. 9 is the second schematic diagram of the combining structure on section of the contacts for the magnetic field generating component and the conductive component of the invention.

Embodiment 3, as shown in FIG. 9, is a schematic diagram of another non-mean equal division structure of the combined sections of the magnetic field generating component 83 and the conductive component 82, as described in conjunction with embodiment 1 above. Along a central axis, the cylindrically shaped body of the magnetic field generating component is sectioned obliquely and asymmetrically from top to bottom, the section is a triangle 836. This means that, from a front view sight, the area of the magnetic field generating component 83 can be smaller than the area of the conductive component 82.

Figure 10:
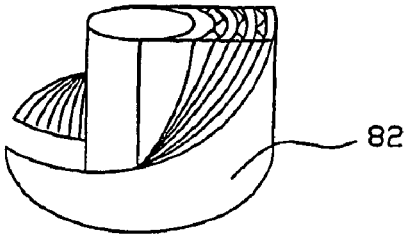
FIG. 10 is a schematic diagram of the conductive component structure of the contact for another embodiment of the invention, when the component is a whole and its shape coordinates with the shape of the magnetic field generating component.

In embodiment 4, as shown in FIG. 10, the conductive component 82, as described in conjunction with embodiment 1 above, is no longer a multi-layer cylinder, but a whole, which is coordinated with the magnetic field generating component.

Figure 11:
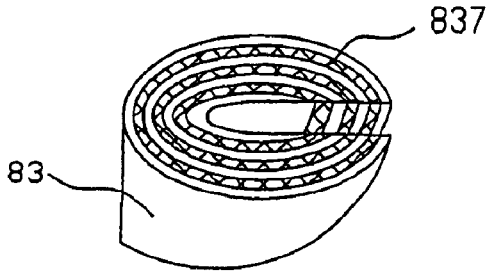
FIG. 11 is a schematic diagram of multi-layer magnetic field generating component structure of the contact for another preferred embodiment of the invention, the component has one layer or more than one layer of pure iron.

Embodiment 5, as shown in FIG. 11, is a schematic diagram of the multi-layered structure of the magnetic field generating component 83 of the contact of the present invention with only two pure irons layers 837. Soft magnetic material layers are determined by real requirement of the magnetic field intensity, the higher the intensity required, the more layers are required.

Figure 12:
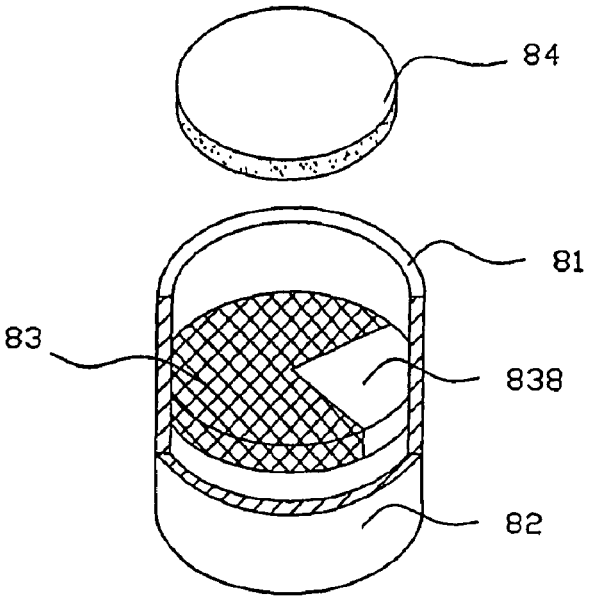
FIG. 12 is a schematic diagram of layer setting combining structure of the magnetic field generating component and the conductive component of the invention.

Embodiment 6, as shown in FIG. 12, is a schematic diagram of a multi-layer combined structure for the magnetic field generating component 83 and the conductive component 82 of the invention. In this embodiment, the magnetic field generating component 83 is a layer shaped body set on the conductive component 82, and above it, the arc proof component 84 is set. The magnetic field generating component 83 has a magnetic path open break 838, and the shapes of the conductive component 82 and the magnetic field generating component 83 are mutually complemented.

Figure 13:
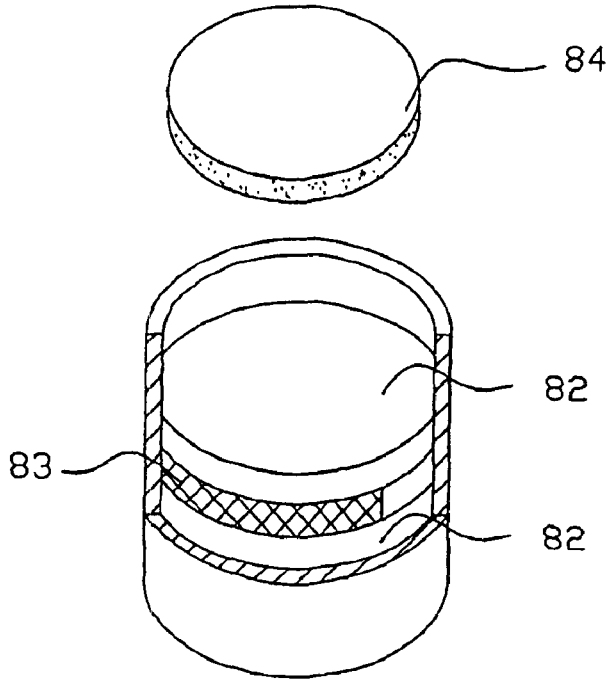
FIG. 13 is a schematic diagram of sandwich layer setting combining structure of the magnetic field generating component and the conductive component of the invention.

Embodiment 7, as shown in FIG. 13, is a schematic diagram of a sandwiched combining structure for the magnetic field generating component 83 and the conductive component 82 of the invention. The magnetic field generating component 83 is a layer shaped body with a magnetic path open break and is set among conductive component layers 82. This means that, at the bottom of the cup-like body 81 is a layer of the conductive component 82; the magnetic field generating component 83 with the magnetic path open break is set on the bottom layer conductive component 82; finally, the arc proof component 84 is set above the top conductive component layer 82. In one or more embodiments, the magnetic field generating component can be more than one layer.

Figure 14:
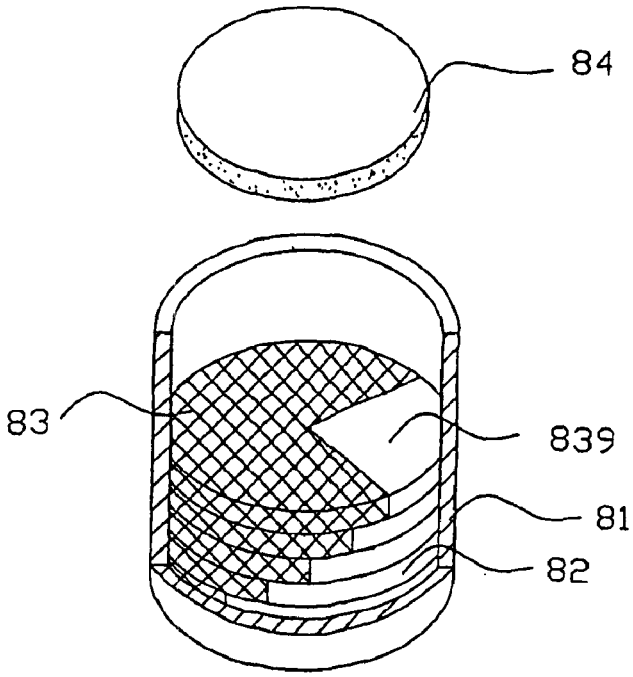
FIG. 14 is a scenograph diagram of the layer structure, with trapezium setting combining from bottom to top, of the magnetic field generating component and the conductive component of the invention.

Embodiment 8, as shown in FIG. 14, is a schematic diagram of a layer shaped structure with a trapezium shape, combining the relationship from bottom to top for the magnetic field generating component 83 and the conductive component 82 according to one embodiment of the invention. Layers, one layer or more than one layer, of the conductive component 82 and the magnetic field generating component 83 are piled layer by layer. Each layer of the conductive component 82 is combined with the corresponding layer of the magnetic field generating component 83. From bottom to top, the area of every layer of the conductive component is gradually decreased and the area of the corresponding layer of the magnetic field generating component is gradually increased. Every layer of the magnetic field generating component 83 has an open break 839 which cuts off the magnetic path. The shape of the combining of the conductive component 82 and the magnetic field generating component 83 is coordinated with the inner wall shape of the cup-like body 81. Then, the arc proof component 84 is set on top of the combination of the conductive component 82 and the magnetic field generating component 83.

The shape of the open break shape 839 of each magnetic field generating component layer 83 is different; as the distance from the contact surface increases, the larger the open break is, in order to guarantee sufficient intensity of the magnetic field between the contacts.

Figure 1:
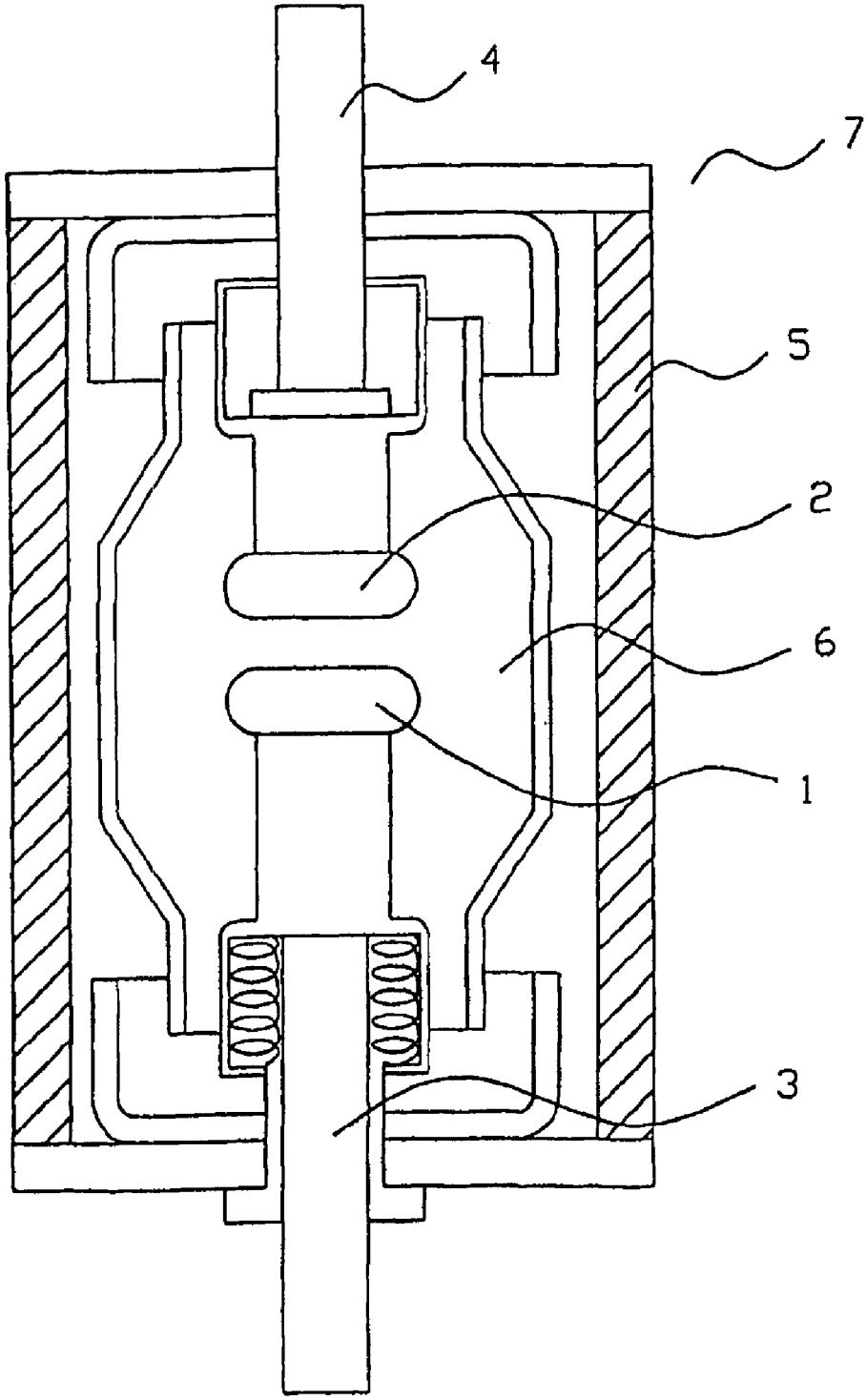
FIG. 1 is a schematic diagram of an arc extinguished chamber basic structure of current vacuum interrupter.
Figure 2:
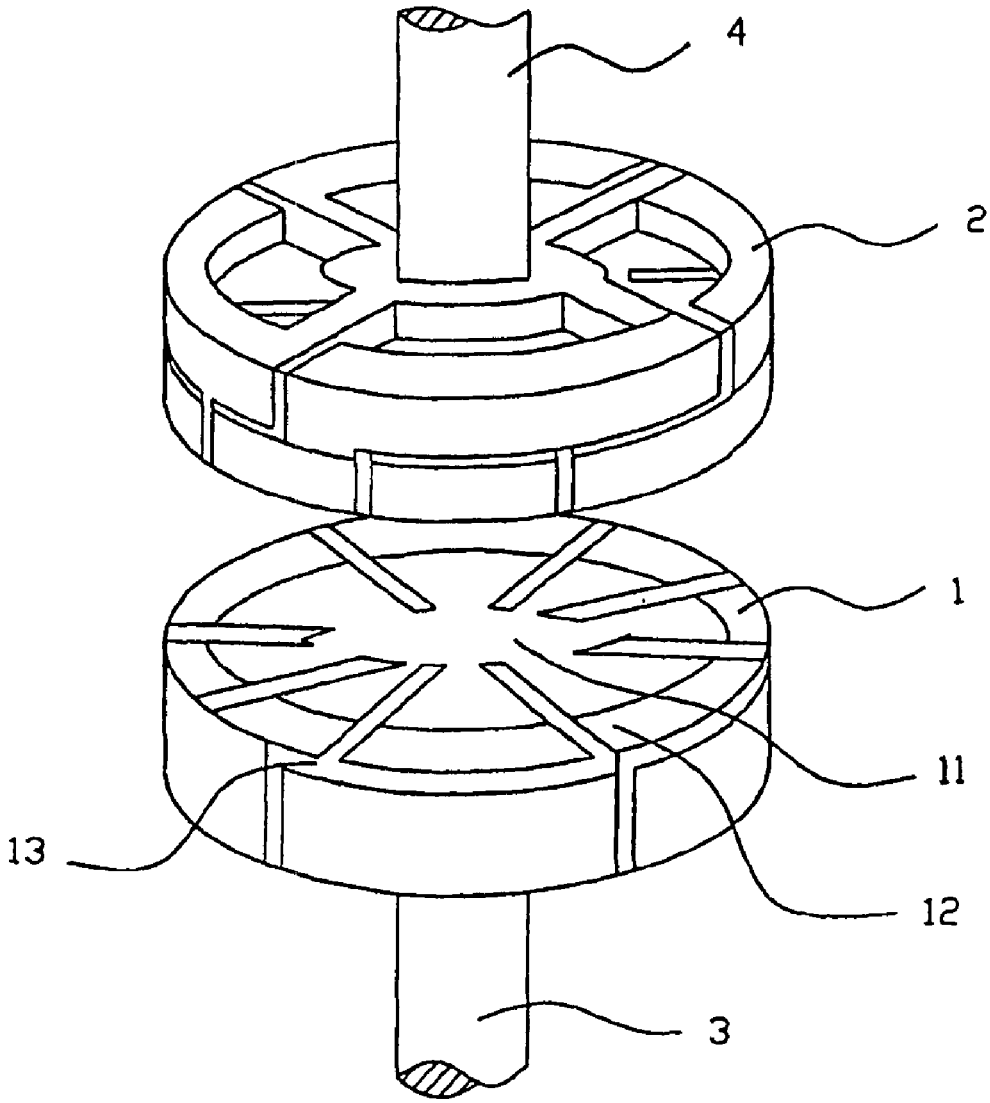
FIG. 2 is a schematic diagram of the contact structure of current arc extinguished chamber.
Figure 3:
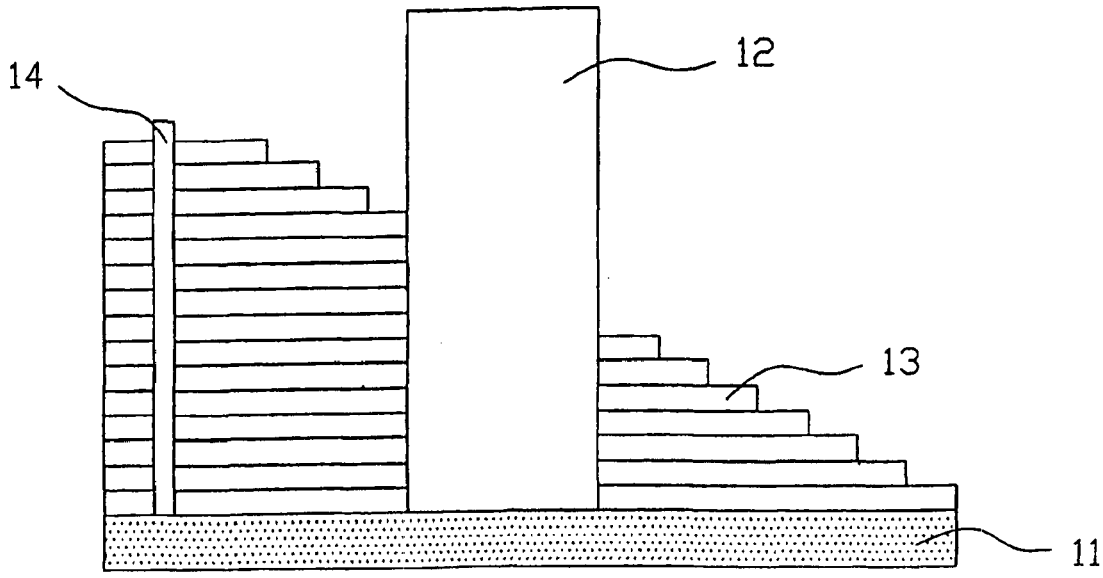
FIG. 3 is a schematic diagram of another contact structure of present vacuum interrupter.
Figure 4:
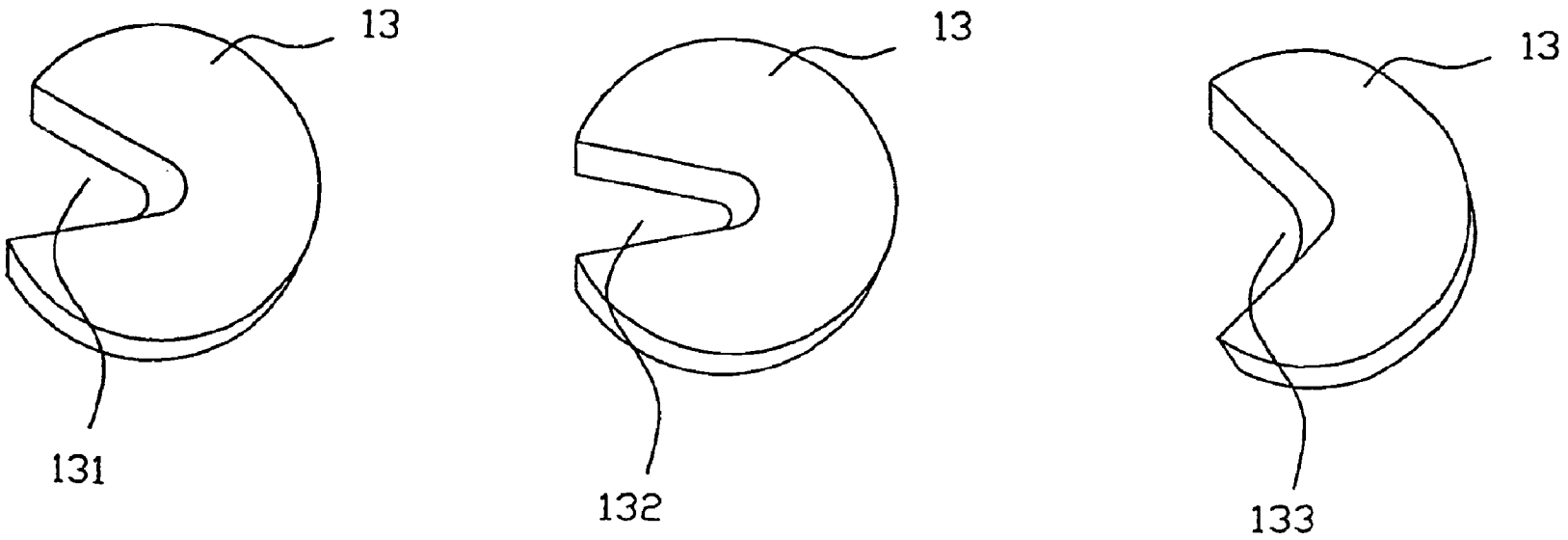
FIG. 4 is a schematic diagram of the plane structure of the magnetic field generating component shown in FIG. 3.
Figure 15:
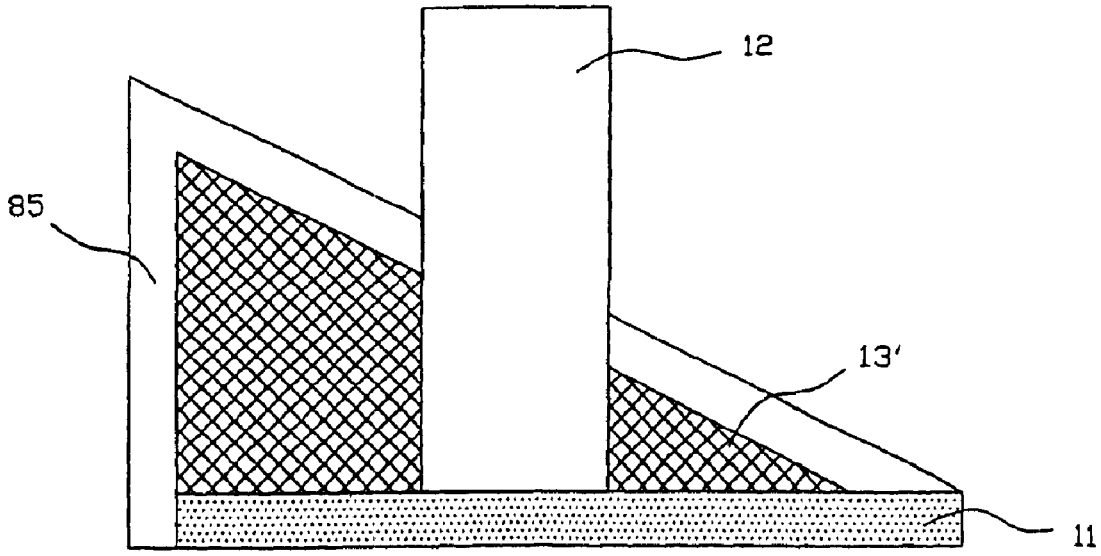
FIG. 15 is a schematic diagram of application structure with using technical scheme of the invention to the present technology shown in FIG. 3 and FIG. 4.

In embodiment 9, as shown in FIG. 15, when the container 85 of the present invention is used in the old contact structure of FIG. 3 and FIG. 4, it will greatly simplify the connection of the old multi-layer magnetic field generating component 13. The connection is achieved by directly putting layer sheets into the container 85, and then melting and sintering in furnace. There is no need to rivet with rivet 14 or soldering layer by layer. This simplifies technology, decreases cost and improves product quality; the original layer sheet or board material can be substituted by a powder of soft magnetic material; requirements for the material are greatly lowed. It has been further described that technical thinking of the invention makes a breakthrough improvement.

Every component of the invention can be made with various materials with various states. For example, the material of the conductive component 82 can be conductive, electric and heat, and high magnetic resistance, such as copper, its state can be powder, sheet or board, bar, tube or block; the material of the magnetic field generating component 83 can be partly or totally soft magnetic material, such as electrical iron. Part of the magnetic field generating component 83 state can be powder, sheet or board, bar, tube or block. The state of the soft magnetic material can be powder, sheet, bar, tube or block.

According to the structure design of the invention, the production process of the interrupter contact can be simplified entering the furnace one time to seal and complete the whole assembly. In addition, there is no need of a soldering process, not only saving solder, but also guaranteeing reliability of component connection and increasing the standard of the product.

The integrated structure as shown in the previous embodiments of the present invention packs all contact components into a container. The meaning of this improvement is comparable with an electronic circuit improved from separated elements to an integrated circuit. The whole-integrated structure thoroughly changes the separated setting structure of the current technology, it tightens geometric size, shrinks volume and increases current density.

Embodiments of the present invention, disclosed herein, expands the types of magnetic field generating component and conductive component, that can be used and also makes use of powder materials, and uncertain shape materials, as there is an external packing container. Therefore, various embodiments of the present invention greatly expand the range of general materials that can be used in contacts for vacuum interrupters.

Magnetic flux is efficiently generated, magnetic resistance is low, axial magnetic field intensity is very high and well distributed; magnetic flux comes in and goes out on the contact surface many times and forms its own close loop; and it can better avoid the influence of external stray magnetic fields on the interrupting capability of the contacts; the arc is well controlled and in a diffusion state; contributing to an increase in the interrupting capability.

As sections of the magnetic field generating component and the conductive component are mutually combined; heat conductivity efficiency increases, which raises the interrupting capability, and also solves the damage problem of the contact body caused by deformation due to asymmetry of the heat contactor in the current technology, and it also saves materials, as every cut component can be combined with another corresponding component, reducing leftover bits and pieces during manufacturing.

Component materials need not be restricted to an alloy with a certain ratio of CuCr manufactured specially for a contact, and need not be in a special shape for components, but general copper, iron and rustless steel sections available in the market can be used. This makes manufacturing easy and decreases cost.

The structure of every component is simple and easy to process and assemble. With entering furnace once and sealing once, the whole assemble is completed with high product ratio of up to standard. Soldering processes are not needed; this not only saves solder, but also guarantees connection reliability of the components.

As used in this description, "one embodiment," "one or more embodiments," "an embodiment" or similar phrases means that feature(s) being described are included in at least one embodiment of the invention. References to "one embodiment" or any reference to an embodiment in this description do not necessarily refer to the same embodiment; however, neither are such embodiments mutually exclusive. Nor does "one embodiment" imply that there is but a single embodiment of the invention. For example, a feature, a structure, act, etc. described in "one embodiment" may also be included in other embodiments. Thus, the invention may include a variety of combinations and/or integrations of the embodiments described herein.

It will be apparent to those skilled in the art that various modifications can be made without departing from the scope and spirit of the present invention. It is intended that the present invention covers modifications and variations of the systems and methods provided they fall within the scope of the claims and their equivalents. Further, it is intended that the present invention cover present and new applications of the system and methods of the present invention.

I claim:

1. An integrated contact, comprising:

an arc proof component;

a conductive component;

a magnetic field generating component, having a top and a bottom and a through hole extending from the top to the bottom; and a container having a center, a top, and a cylindrical inner sidewall, wherein the arc proof component, the conductive component and the magnetic field generating component are set in the container, the magnetic field generating component and the conductive component are mutually combined to form a cylindrical body which fits the cylindrical inner sidewall of the container, so that the container holds the cylindrical body in position, and the arc proof component is set on top of the combination of the magnetic field generating component and the conductive component; the combination of the magnetic field generating component and the conductive component are configured to produces a magnetic field.

2. The integrated contact, as in claim 1, wherein the magnetic field generating component has an through oblique section from the top to the bottom at a side facing the center of container, with a magnetic path of the magnetic field generating component opened by a break from top to bottom, and the conductive component has a supporting oblique section coinciding with the oblique section of the magnetic field generating component, and when the magnetic field generating component is combined with the conductive component, the oblique section of the magnetic field generating component matches the supporting oblique section of the conductive component.

3. The integrated contact, as in claim 2, wherein the oblique section of the magnetic field generating component corresponds with the supporting oblique section of the conductive component and the combination of the magnetic field generating component and the conductive component is an asymmetric division structure.

4. The integrated contact, as in claim 2, wherein the oblique section of the magnetic field generating component corresponds with the supporting oblique section of the conductive component and the combination of the magnetic field generating component and the conductive component forms a symmetric mean equal division structure.

5. The integrated contact, as in claim 1, wherein the magnetic field generating component is a multi-layer cylinder structure comprising cylindrical-shape layers with different diameters arranged substantially parallel with an axial direction of the cylindrical body, the multi-layer structure has at least one layer of magnetic material with insulation between every two layers, and at least one layer is a soft magnetic material layer, and wherein the conductive component is a multi-layer cylinder structure comprising cylindrical-shape layers with different diameters arranged substantially parallel with an axial direction of the cylindrical body, an inner cylinder body is located at a center of the multi-layer cylinder structure of the conductive component and configured for insertion into the through hole in the magnetic field generating component.

6. The integrated contact, as in claim 5, wherein the multi-layer cylinder structure of the magnetic field generating component and the multi-layer cylinder structure of the conductive component have the same number of layers.

7. The integrated contact, as in claim 2, wherein the magnetic field generating component is a multi-layer cylinder structure comprising cylindrical-shape layers with different diameters arranged substantially parallel with an axial direction of the cylindrical body, the multi-layer cylinder structure has at least one layer of magnetic material with insulation between every two layers, and at least one layer is a soft magnetic material layer, and wherein the conductive component is a multi-layer cylinder structure comprising cylindrical-shape layers with different diameters arranged substantially parallel with an axial direction of the cylindrical body, an inner cylinder body is located at a center of the multi-layer cylinder structure of the conductive component and configured for insertion into the through hole in the magnetic field generating component, wherein a number of the cylindrical-shape layers of the multi-layer cylinder structure of the magnetic field generating component is equal to a number of the cylindrical-shape layers of the multi-layer cylinder structure of the conductive component.

8. The integrated contact, as in claim 1, wherein the magnetic field generating component is a layer shaped body having at least one layer, and the conductive component is a layer shaped body having at least one layer and the magnetic field generating component is set on the conductive component or sandwiched between two layers of the conductive component.

9. The integrated contact, as in claim 2, wherein the container is a cup-like body made from rustless steel, whose melting point is above eleven hundred (1100) degrees Centigrade.

10. The integrated contact, as in claim 1, wherein the arc proof component is a mixture of copper powder and chromium powder and the ratio of the copper powder and the chromium powder is varied from 10:90 to 90:10.

11. The integrated contact, as in claim 1, wherein the arc proof component is made from a sheet or a block of copper chromium alloy.

12. The integrated contact, as in claim 1, wherein the conductive component is made of copper and a material state of the conductive component is selected from the group consisting of powder, sheet, board, bar, tube and block.

13. The integrated contact, as in claim 5, wherein the soft magnetic material is electrical iron and the state of the soft magnetic material is selected form the group consisting of powder, sheet, board, bar, tube, and block.

14. The integrated contact, as in claim 1, wherein the cylindrical body of the magnetic field generating component and the conductive component comprises a plurality of layers stacked over each other along an axial direction of the cylindrical body, each layer has a disc shape with a diameter slightly smaller than a diameter of the cylindrical inner sidewall of the container, each layer contains a portion of the magnetic field generating component and a portion of the conductive component and, from the bottom to the top of the container, an area occupied by the conductive component in each layer gradually decreases, and an area occupied by the magnetic field generating component in each layer gradually increases.

15. The integrated contact, as in claim 1, wherein a diameter of the cylindrical body of the magnetic field generating component and the conductive component is slightly smaller than a diameter of the cylindrical inner sidewall of the container, so that the cylindrical body is well fitted with the cylindrical inner sidewall.

16. The integrated contact, as in claim 5, wherein the multi-layer cylinder structure of the magnetic field generating component and the multi-layer cylinder structure of the conductive component have different number of layers.

* * * * *